US011749109B2

(12) United States Patent
Sharma

(10) Patent No.: US 11,749,109 B2
(45) Date of Patent: Sep. 5, 2023

(54) ADAPTIVE TRAFFIC MANAGEMENT SYSTEM

(71) Applicant: ETALYC, INC., Ames, IA (US)

(72) Inventor: Anuj Sharma, Ames, IA (US)

(73) Assignee: ETALYC INC., Ames, IA (US)

( * ) Notice: Subject to any disclaimer, the term of this patent is extended or adjusted under 35 U.S.C. 154(b) by 57 days.

(21) Appl. No.: 17/128,644

(22) Filed: Dec. 21, 2020

(65) Prior Publication Data

US 2021/0192944 A1 Jun. 24, 2021

Related U.S. Application Data

(60) Provisional application No. 62/950,729, filed on Dec. 19, 2019.

(51) Int. Cl.
*G08G 1/081* (2006.01)
*G08G 1/01* (2006.01)

(52) U.S. Cl.
CPC ..... *G08G 1/081* (2013.01); *G08G 1/0112* (2013.01); *G08G 1/0116* (2013.01); *G08G 1/0145* (2013.01)

(58) Field of Classification Search
CPC .... G08G 1/0145; G08G 1/081; G08G 1/0112; G08G 1/0116
See application file for complete search history.

(56) References Cited

U.S. PATENT DOCUMENTS

| | | | | |
|---|---|---|---|---|
| 7,317,406 | B2 * | 1/2008 | Wolterman | G08G 1/08 340/905 |
| 8,666,643 | B2 * | 3/2014 | McBride | G08G 1/0116 340/907 |
| 9,349,288 | B2 * | 5/2016 | Raamot | G08G 1/052 |
| 9,412,271 | B2 * | 8/2016 | Sharma | G08G 1/07 |
| 9,682,711 | B2 * | 6/2017 | Lee | A61B 5/0205 |
| 9,779,357 | B1 * | 10/2017 | Dabell | G08G 1/0137 |
| 9,978,270 | B2 * | 5/2018 | Raamot | G08G 1/0116 |
| 10,696,249 | B2 * | 6/2020 | Heinrich | A61B 5/4552 |
| 11,270,583 | B2 * | 3/2022 | Kumar | G05B 15/02 |
| 11,385,625 | B2 * | 7/2022 | Itou | G05B 19/41865 |
| 2006/0181433 | A1 * | 8/2006 | Wolterman | G08G 1/164 340/905 |
| 2013/0027221 | A1 * | 1/2013 | Johnson | G08G 1/087 340/902 |
| 2014/0341441 | A1 * | 11/2014 | Slaby | G06V 40/193 382/117 |
| 2015/0025655 | A1 * | 1/2015 | Walther | G08G 1/04 700/9 |

(Continued)

FOREIGN PATENT DOCUMENTS

WO WO-2021067062 A1 * 4/2021 ..... G08G 1/0116

*Primary Examiner* — Luis A Martinez Borrero
(74) *Attorney, Agent, or Firm* — Zarley Law Firm P.L.C.

(57) ABSTRACT

An adaptive traffic management system includes a plurality of traffic lights positioned at a plurality of roadway intersections. Associated with each intersection is one or more sensors to detect traffic flow. A control system is connected to the traffic lights and the sensors and based upon data received and predetermined weights for various situations generates a signal timing plan that operates the traffic lights. The control system also may be connected to multiple sources, wearables, and/or in-vehicle sensors that are also used to generate the signal timing plan and operate the traffic lights.

20 Claims, 4 Drawing Sheets

(56) References Cited

U.S. PATENT DOCUMENTS

| | | | | |
|---|---|---|---|---|
| 2015/0061896 | A1* | 3/2015 | Walther | G05B 15/02 340/909 |
| 2016/0027299 | A1* | 1/2016 | Raamot | G08G 1/0112 340/917 |
| 2016/0027300 | A1* | 1/2016 | Raamot | G08G 1/0145 340/922 |
| 2016/0264131 | A1* | 9/2016 | Chan | A61B 5/6893 |
| 2017/0098372 | A1* | 4/2017 | Eilertsen | G08G 1/0133 |
| 2017/0140141 | A1* | 5/2017 | Yan | G06F 21/32 |
| 2018/0229674 | A1* | 8/2018 | Heinrich | B60K 28/063 |
| 2019/0051171 | A1* | 2/2019 | Malkes | G08G 1/08 |
| 2019/0213875 | A1* | 7/2019 | Eilertsen | G08G 1/0145 |
| 2019/0357834 | A1* | 11/2019 | Aarts | A61B 5/7246 |
| 2020/0334978 | A1* | 10/2020 | Pittman | H04L 47/821 |
| 2020/0334979 | A1* | 10/2020 | Gonçalves | G08G 1/0129 |
| 2021/0049904 | A1* | 2/2021 | Zavesky | G08G 1/096783 |
| 2021/0183244 | A1* | 6/2021 | Malhan | B64U 50/34 |
| 2021/0248903 | A1* | 8/2021 | Eilertsen | G08G 1/056 |

* cited by examiner

| # Int | Mov | Type/Mode | Time | Opt Mode | Wt. | Func |
|---|---|---|---|---|---|---|
| 1,2, 3 | Main Thru-NB | Progression (Upstream) Thru)- Veh | Morning Peak | Manual $ | 5 $/stop/veh | Fixed |
| 1,2, 3 | Main Thru-NB | Delay | All-Time | Auto | 0.30 $/min/veh | Fixed |
| 1,2, 3 | Main Left | Delay | All-Time | Auto | 0.20 $/min/veh | Fixed |
| 2 | EBL | Queue Length/Veh | All-Time | Manual ($) | 15 $/bay failure | Step |
| | | | | | | |

Optimization Base Mode

Ramp Clearance

Time

Freeway Event

| # Int | Mov | Type/Mode | Time | Opt Mode | Wt. | Funct. |
|---|---|---|---|---|---|---|
| 1, 2 3 | NB Thru Yellow Conflict | Nos. DLZ Incursions | Event (weather) | Auto | 5 $/stop/veh | Fixed |
| 3 | Main-Ped Conflict | Veh-Ped Exposure | Event (Weather) | Auto | 5 $ (exposure prob > 0.5 per cycle) | Step |
| 3 | NBL | Delay | Event (Weather) | Auto | 0.05 $/min/veh | Fixed |

ADAPTIVE TRAFFIC MANAGEMENT SYSTEM

CROSS REFERENCE TO RELATED APPLICATION

This application claims the benefit of U.S. Provisional Application No. 62/950,729, filed Dec. 19, 2019, the contents of this application is hereby incorporated by reference in its entirety.

BACKGROUND OF THE INVENTION

The present invention is directed to an adaptive traffic management system and more particularly an artificial intelligence based adaptive traffic management system that optimizes user-defined spatio-temporally varying objectives using heterogeneous and multi-resolution data sources.

Traffic management systems are known in the art and are used to ensure that traffic and pedestrians move as smoothly and safely as possible. A variety of different control systems are used to accomplish this, ranging from simple clockwork mechanisms to sophisticated computerized control and coordination systems that self-adjust to minimize delay.

While useful, the sophisticated computerized systems utilize a pre-defined objective function which is a combination of delays, stops, queue length, and the like. The traffic signal manager/engineer is not permitted to alter these pre-defined objectives for different problems and/or situations which may arise in traffic management.

As a result, current adaptive or signal timing optimization plans do not meet the expectations of the general public and traffic manager/engineers. This has led to less than 5% adoption of adaptive signal timing systems in the United States. Instead traffic managers tweak software driven signal timing plans. This process of tweaking is called fine-tuning of the signals. This "tweaking" process is time consuming and does not always solve the problem.

Accordingly, there exists a need in the art for a system that addresses these deficiencies.

An objective of the present invention is to provide an adaptive traffic management system that permits a manager/engineer to alter pre-defined objectives for different problems and/or situations which may arise.

Another objective of the present invention is to provide an adaptive traffic management system that meets the expectation of the general public and traffic manager/engineers.

These and other objectives will be apparent to those of ordinary skill in the art based upon the following written description, drawings, and claims.

SUMMARY OF THE INVENTION

An adaptive traffic management system that includes a plurality of traffic lights positioned at a plurality of roadway intersections. Associated with each of the plurality of roadway intersections is at least one sensor to detect traffic flow. Both the sensors and the traffic lights are connected to a control system.

Predetermined weights are entered into the control system and based upon the predetermined weights and the information received from the sensors the control system generates a signal timing plan. Based upon the signal timing plan, the control system controls the operations of the lights.

In addition to the predetermined weights and information from sensors, information from multiple sources, driver wearables, and in-vehicle sensors may also be used to provide information to the control system for use in generating the signal timing plan and operating the traffic lights based upon different situations and conditions.

The system has multiple modes of operations which use default weights for various problems and/or situations. In addition to generating signal timing plans, the control system can also generate and provide route guidance to a driver based upon different problems and situations.

The control system is adapted to use artificial intelligence and traffic theory principles to generate the signal timing plans, default weights for modes of operation and for the development of route-guidance.

DETAILED DESCRIPTION OF THE PREFERRED EMBODIMENTS

Figure 1:
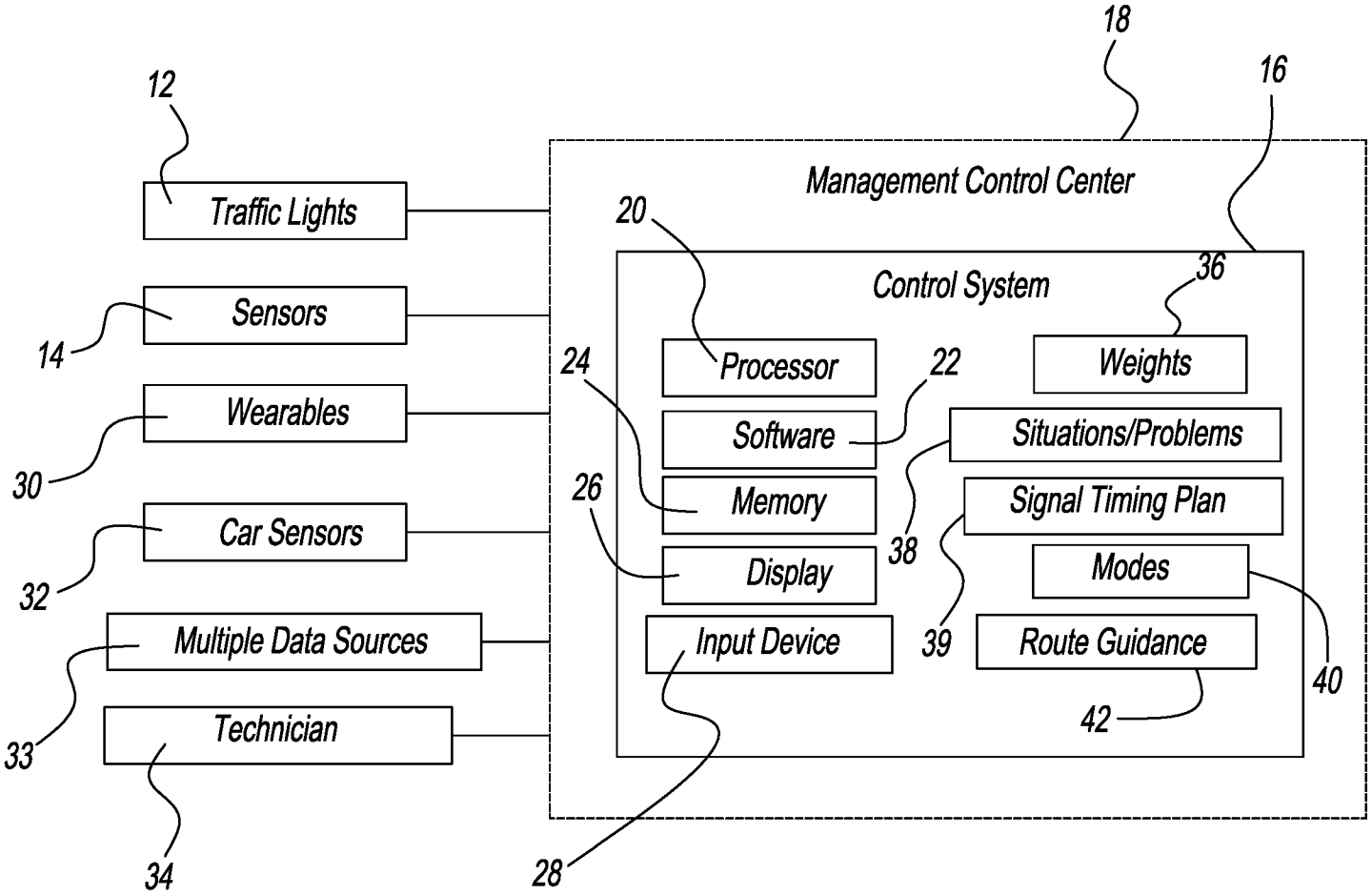
FIG. 1 is a schematic view of an adaptive traffic signal control system.
Figure 2:
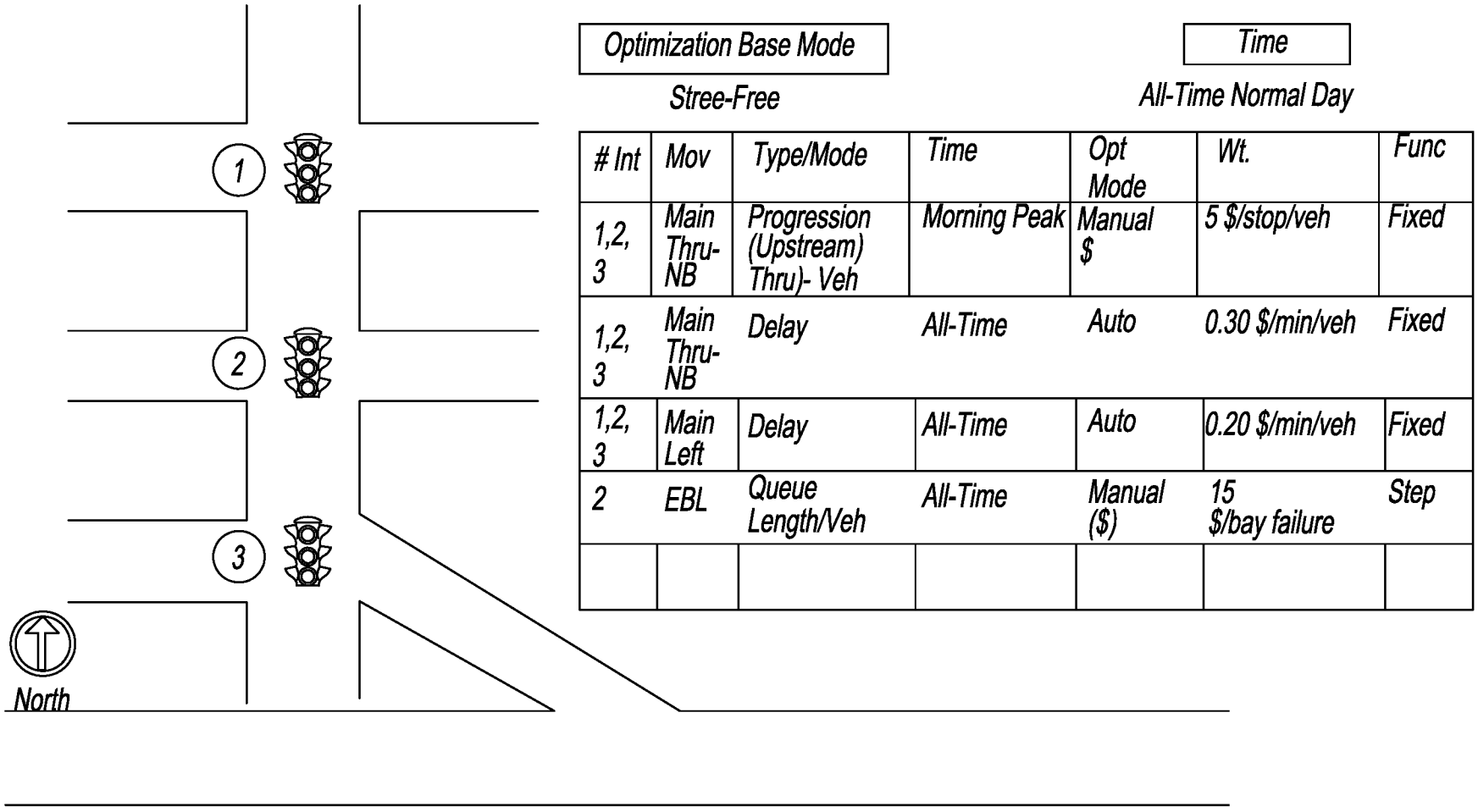
FIG. 2 is a plan view of a signal timing plan.
Figure 3:
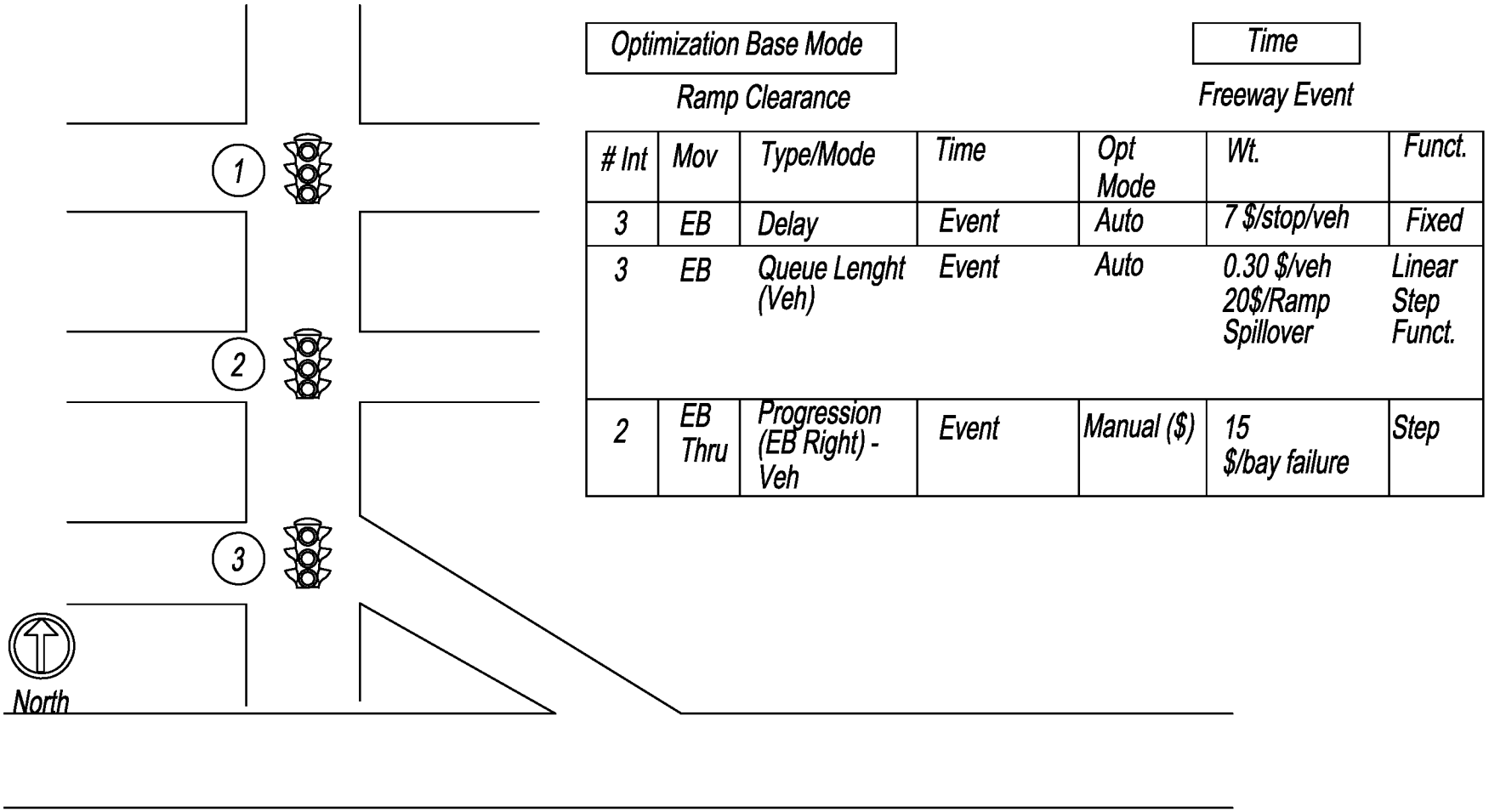
FIG. 3 is a plan view of a signal timing plan.
Figure 4:
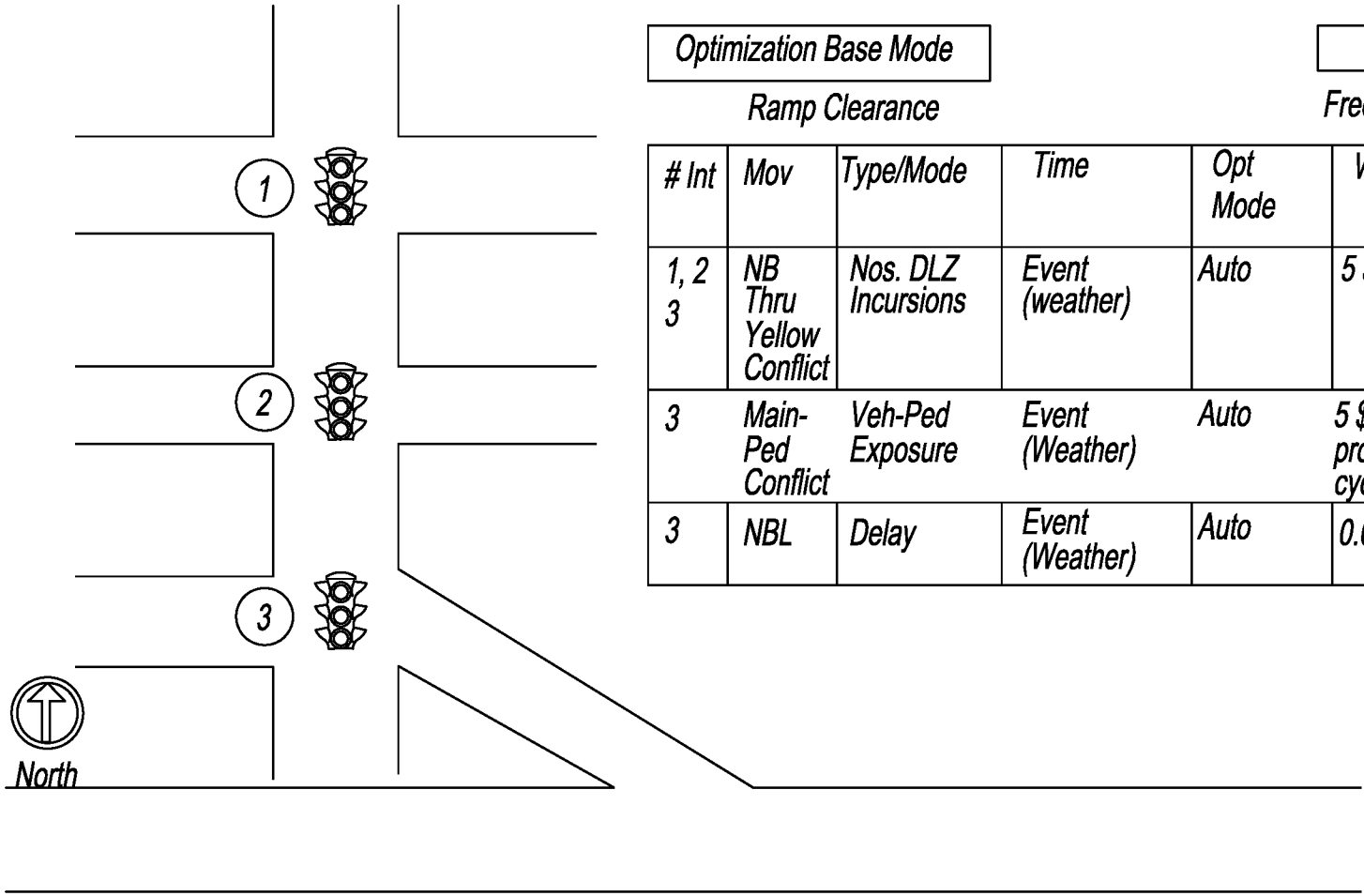
FIG. 4 is a plan view of a signal timing plan.

Referring to the Figures, an adaptive traffic management system 10 includes a plurality of traffic lights 12 positioned at a plurality of roadway intersections. Associated with each intersection is one or more sensors 14 to detect traffic flow. The sensors 14 include, but are not limited to cameras, inductive loop detectors, radars, magnetometers, motion sensors, radio frequency identification (RFID), E-Z pass tag, or the like.

In addition to the sensors 14, data is automatically collected from multiple sources 33 and used by a control system 16 to estimate change of traffic demand and quality of operations at an intersection. Examples of the multiple sources 33 include weather predictions/reports in the region, twitter feeds talking about an upcoming event, and complaint logs that explain a problem faced by commuters.

Both the traffic lights 12 and sensors 14 are connected to the control system 16 to a traffic management control center 18. The control system 16 includes a processor 20, software 22, memory 24, a display 26, and an input device 28. The control system 16 could also be connected to wearables 30 and/or in-vehicle sensors 32 that are in proximity of a given signalized intersection.

Using the software 22 of the input device 28, a technician 34 enters weights 36, for problems/situations 38 that exist in the system 10 to generate a signal timing plan 39. The weights 36, for problems/situations 38 are of any type. In one example, at one intersection a side street delay may be given a cost per vehicle weight of 0.2 $/vehicle and a main street delay given a weight of 0.5 $/vehicle. These values can be changed by the technician. These values can also be converted into more understandable classes such as high, medium, and low dial that can be operated by the technician. In another example, the weight 36 is a function, such as a step function where based on rules/criteria weights 36 are changed by the system 10 at different levels. In yet another example, weights 36 are changed spatially, temporally, by specific times, and/or events. More specifically, a higher weight 36 is given for delays on a busy side street and a lower weight 36 to a rarely used side street, or different weights 36 assigned for morning peak, afternoon peak, late night, or events such as sporting events or concerts.

The system 10 also has several modes 40 of operation. The modes 40 are of any type and have default weights 36 that promote the mode's objective. Examples of modes 40 include, but are not limited to, a mode to minimize public complaints, another to promote emission minimization, one to handle special events, incidents, weather, and the like.

Another mode 40 example is to promote a minimization in driver stress. For this mode 40, through the wearable 30 and/or vehicle sensor 32 a driver's heart rate, galvanic skin-conductance and other physiological parameters are transmitted to the control system 16. Based upon analysis, weights are assigned for different areas such as at an intersection based on a detected stress/anxiety level. In this mode both long-term observation of stress/anxiety at intersections will be used to associate a weight 36 for optimization and real-time measurements are used for short term adaptations. Default weights for all modes 40 are calculated by the control system using data from multiple sources and not just from sensors present near an intersection.

Based upon the weights 36 assigned by the technician 34 and/or the default weights 36 calculated by the control system 16, the control system 16 operates the traffic lights 12. In addition to controlling the traffic lights 12, the control system 16 determines and provides route-guidance 42 derived from data to minimize motorized and non-motorized traffic stress. The route-guidance 42 for minimal stress routes are provided through a stand-alone mobile application or used as a stream consumed by existing route-guidance services.

While technicians 34 assign weights 36, the control system 16 also uses artificial intelligence and traffic theory principles to generate signal timing plans 39, default weights 36 for modes 40, and route-guidance 42.

From the above discussion and accompanying figures and claims it will be appreciated that the adaptive traffic control system 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. An adaptive traffic management system, comprising:

a plurality of traffic lights positioned at a plurality of roadway intersections;

at least one sensor associated with each of the plurality of roadway intersections to detect traffic flow;

a control system connected to the plurality of traffic lights and the at least one sensor;

a wearable configured to sense and transmit a physiological parameter of a driver to the control system;

wherein, based upon an information received from the at least one sensor, the physiological parameter transmitted by the wearable, and predetermined weights for multiple situations, the control system generates a signal timing plan and operates the plurality of traffic lights based upon the signal timing plan.

2. The system of claim 1 wherein the signal timing plan is further based upon information from multiple sources that are connected to the control system.

3. The system of claim 1 wherein the signal timing plan is further based upon in-vehicle sensors that are in proximity to a given one of the plurality of roadway intersections and connected to the control system.

4. The system of claim 1 further comprising a plurality of modes of operation that include default weights.

5. The system of claim 1 wherein the control system determines and provides route-guidance to a vehicle to minimize traffic stress.

6. The system of claim 1 wherein the at least one sensor is selected from a group consisting of an inductive loop detector and a magnetometer.

7. The system of claim 1 further comprising at least one source selected from a group consisting of a complaint log and a weather prediction for a region, wherein the control system generates the signal timing plan based on the at least one source.

8. The system of claim 1 further comprising an input device configured to receive an assigned weight entered by a technician; wherein the assigned weight is alterable by the technician and the control system generates the signal timing plan based on the assigned weight.

9. The system of claim 1 further comprising an in-vehicle sensor, wherein the control system generates the signal timing plan based on an information from the in-vehicle sensor.

10. The system of claim 1 wherein the control system has a software, and the software has a plurality of modes of operation wherein a mode of operation of the plurality of modes of operation is selected from a group consisting of a mode to minimize public complaints, a mode to promote emission minimization, and the mode to minimize driver stress.

11. The system of claim 10 wherein the mode of operation is the mode to minimize driver stress, the weight is optimized based on a long-term observation of stress and real-time measurements of stress derived from the physiological parameter.

12. The system of claim 1 wherein the software is configured to generate the signal timing plan based on a weight derived from a step function having at least one criteria selected from a group consisting of a spatial criteria and a temporal criteria.

13. The system of claim 1 wherein the physiological parameter is selected from a group consisting of a driver's heart rate and a driver's galvanic skin-conductance.

14. An adaptive traffic management system, comprising:

a plurality of traffic lights positioned at a plurality of roadway intersections;

at least one sensor associated with each of the plurality of roadway intersections to detect traffic flow, wherein the at least one sensor is selected from a group consisting of an inductive loop detector and a magnetometer;

at least one source, wherein the at least one source is selected from a group consisting of a complaint log and a weather prediction for a region;

a wearable configured to sense and transmit a physiological parameter of a driver to the control system, wherein the physiological parameter is selected from a group consisting of a driver's heart rate and a driver's galvanic skin-conductance;

an in-vehicle sensor;

an input device configured to receive an assigned weight entered by a technician;

a control system having a software connected to the plurality of traffic lights, the at least one sensor, the at least one source, the wearable, the in-vehicle sensor, and the input device;

the software having a plurality of modes of operation wherein a mode of operation of the plurality of modes of operation is selected from a group consisting of a mode to minimize public complaints, a mode to promote emission minimization, and a mode to minimize driver stress; and wherein, based upon an information received by the control system from the at least one sensor, the at least one source, the physiological parameter transmitted by the wearable, the in-vehicle sensor, the assigned weight received by the input device, and at least one predefined weight based on the mode of operation, the software of the control system calculates a weight for each of the plurality of roadway intersections to generate a signal timing plan and operates the plurality of traffic lights based upon the signal timing plan.

15. The system of claim 14 wherein the software is configured to change the weight based on a step function having at least one criteria selected from a group consisting of a spatial criteria and a temporal criteria.

16. The system of claim 14 wherein the mode of operation is the mode to minimize driver stress, the weight is optimized based on a long-term observation of stress and real-time measurements of stress derived from the physiological parameter.

17. The system of claim 14 wherein the assigned weight is configured to be modified by the technician.

18. The system of claim 14 wherein an operation of the plurality of traffic lights is alterable by the technician.

19. The system of claim 14 wherein the software of the control system is configured to provide a route-guidance to minimize stress of the driver along a route.

20. An adaptive traffic management system, comprising:

a plurality of traffic lights positioned at a plurality of roadway intersections;

at least one sensor associated with each of the plurality of roadway intersections to detect traffic flow, wherein the at least one sensor is selected from a group consisting of an inductive loop detector and a magnetometer;

at least one source, wherein the at least one source is selected from a group consisting of a complaint log and a weather prediction for a region;

a wearable configured to sense and transmit a physiological parameter of a driver to the control system, wherein the physiological parameter is selected from a group consisting of a driver's heart rate and a driver's galvanic skin-conductance;

an in-vehicle sensor;

an input device configured to receive an assigned weight entered by and alterable by a technician;

a control system having a software connected to the plurality of traffic lights, the at least one sensor, the at least one source, the wearable, the in-vehicle sensor, and the input device;

the software having a plurality of modes of operation wherein a mode of operation of the plurality of modes of operation is selected from a group consisting of a mode to minimize public complaints, a mode to promote emission minimization, and a mode to minimize driver stress;

wherein, based upon an information received by the control system from the at least one sensor, the at least one source, the physiological parameter transmitted by the wearable, the in-vehicle sensor, the assigned weight received by the input device, and at least one predefined weight based on the mode of operation, the software of the control system calculates a weight for each of the plurality of roadway intersections to generate signal timing plan and operates the plurality of traffic lights based upon the signal timing plan;

wherein the software is configured to change the weight based on a function having at least one criteria selected from a group consisting of a spatial criteria and a temporal criteria;

wherein the mode of operation is the mode to minimize driver stress, the weight is optimized based on a long-term observation of stress and real-time measurements of stress derived from the physiological parameter and the control system is configured to provide a route-guidance to minimize stress on the driver.

* * * * *